US005893818A

United States Patent [19]

Zahiri et al.

[11] Patent Number: 5,893,818

[45] Date of Patent: Apr. 13, 1999

[54] AXIAL LOADING APPARATUS FOR STRENGTHENING THE SPINE

[76] Inventors: Christopher A. Zahiri; Hormoz Zahiri, both of 11718 Chenault St., Los Angeles, Calif. 90049

[21] Appl. No.: 09/134,467

[22] Filed: Aug. 14, 1998

[51] Int. Cl.[6] ..... A63B 23/02; A63B 21/06

[52] U.S. Cl. ..... 482/10; 482/94; 482/133

[58] Field of Search ..... 482/10, 93, 94, 482/97–103, 105, 133; 602/32, 34; 601/24, 39

[56] References Cited

U.S. PATENT DOCUMENTS

| | | | |
|---|---|---|---|
| 1,047,212 | 12/1912 | Hamilton | 482/105 |
| 4,528,990 | 7/1985 | Knowles . | |
| 4,669,106 | 5/1987 | Ammerman . | |
| 5,094,249 | 3/1992 | Marras et al. . | |
| 5,101,835 | 4/1992 | DelRe . | |
| 5,336,138 | 8/1994 | Arjawat . | |
| 5,336,139 | 8/1994 | Miller . | |
| 5,474,086 | 12/1995 | McCormick et al. . | |
| 5,549,534 | 8/1996 | Parviainen . | |
| 5,588,941 | 12/1996 | Scott . | |

*Primary Examiner*—John Mulcahy

*Attorney, Agent, or Firm*—Thomas I. Rozsa; Tony D. Chen; Jerry Fong

[57] ABSTRACT

An axial loading apparatus for applying a continuous compressive force on top of a patient's head which is aligned with the top of the patient's head. The compressive force serves to strengthen the spine. The patient can direct how much force is applied and for how long the force is applied and as the patient's strength and resistance increase, the weights can be increased and the length of time can be increased. The axial loading apparatus comprises a frame member which has a base portion, a vertical portion affixed, and a top inclined portion connected to the vertical portion. The axial loading apparatus further comprises an actuator mechanism for actuating the load onto the patient's head, a locking mechanism for preventing undesirable loading, and a loading and holding mechanism for loading onto the patient's head.

16 Claims, 3 Drawing Sheets

AXIAL LOADING APPARATUS FOR STRENGTHENING THE SPINE

BACKGROUND OF THE INVENTION

1. Field of the Invention

The present invention generally relates to the field of exercise and therapeutic machines. More particularly, the present invention relates to the field of exercise and therapeutic machines for head loading and in particular, vertical or axial loading to strengthen a person's spine.

2. Description of the Prior Art

Many people in our society have serious back disorders due to a lack of physical conditioning. Back disorders are caused by one or a combination of the following reasons: poor posture, use of improper body mechanics, stress, lack of proper exercise, poor health, etc. However, with proper exercise and conditioning, the risk of such injury can be reduced, if not eliminated altogether, by gradually stretching and positioning of the spine to relieve pain and realign the individual vertebrae. Effective exercise provides increased endurance and eliminates muscular problems and range of motion problems.

The following ten (10) prior art patents are found to be pertinent to the field of the present invention:

1. U.S. Pat. No. 4,528,990 issued to Knowles on Jul. 16, 1985 for "Apparatus For Measuring Head And Spine Movement" (hereafter the "Knowles Patent");
2. U.S. Pat. No. 4,669,106 issued to Ammerman on May 26, 1987 for "Apparatus For Aiding In Cervical Spine Radiographic Production" (hereafter the "Ammerman Patent");
3. U.S. Pat. No. 5,094,249 issued to Marras et al. on Mar. 10, 1992 for "Apparatus For Monitoring The Motion Of The Lumbar Spine" (hereafter the "Marras Patent");
4. U.S. Pat. No. 5,101,835 issued to DelRe on Apr. 7, 1992 for "Method And Apparatus For Testing A Spine" (hereafter the "DelRe Patent");
5. U.S. Pat. No. 5,336,138 issued to Aijawat on Aug. 9, 1994 for "Head, Neck, And Shoulder Exercise Machine" (hereafter the "Arjawat Patent");
6. U.S. Pat. No. 5,336,139 issued to Miller on Aug. 9, 1994 for "Isotonic Cervical Exercise Device" (hereafter the "Miller Patent");
7. U.S. Pat. No. 5,474,086 issued to McCormick et al. on Dec. 12, 1995 for "Apparatus For Monitoring The Motion Of The Lumbar Spine" (hereafter the "McCormick Patent");
8. U.S. Pat. No. 5,549,534 issued to Parviainen on Aug. 27, 1996 for "Spine Rehabilitation Apparatus" (hereafter the "Parviainen Patent");
9. U.S. Pat. No. 5,588,941 issued to Scott on Dec. 31, 1996 "Spine Therapy And Exercise Device" (hereafter the "Scott Patent"); and
10. European Patent No. 295,804 issued to Jones for "Method And Apparatus For Testing Or Exercising Muscles Of The Lower Trunk Of The Human Body" (hereafter the "Jones Patent").

The Knowles Patent discloses a head-mounted apparatus for measuring head and spine movement about a substantially vertical axis, and also capable of indicating spine or head tilting. It comprises a head band which is firmly affixed to the head. The head band has an indicia scale used in conjunction with a body reference indicator whereby the indicator is maintained stationary while the spine or head is rotated such that the relationship between the indicator and indicia scale represents the rotated body movement.

The Ammerman Patent discloses an apparatus for aiding in cervical spine radiographic production. The apparatus is used for repositioning shoulders of a prone patient at a displaced position to facilitate the obtaining of an unobstructive lateral radiograph of all seven vertebrae of the cervical section of the spine.

The Marras Patent discloses an apparatus for monitoring the motion of the lumbar spine during flexion and extension in each of several sagittal-frontal planes of the body, as well as during movement into the transverse plane. The apparatus comprises a rotatable platform upon which the patient is adapted to stand, and the platform is pivotable about a vertical axis, so that the platform may be pivoted to a selected angle and locked in position. A pelvic stabilization belt is mounted to the platform, and an overhead frame member is provided for rotation about a horizontal axis which is adapted to pass through the lumbro-sacral junction of the patient. An upper body yoke is mounted to the overhead frame member for rotation about a vertical axis which is perpendicular to the horizontal axis.

The DelRe Patent discloses a method and apparatus for testing a spine. It comprises a spinal contact member which contacts a disc under a low force to obtain the position of the contact member with the disc in its normal or usual unstressed position. The same disc is contacted with the contact member under an elevated increased standard force to obtain a second position of the contact member.

The Arjawat Patent discloses a head, neck, and shoulder exercise machine for exercising the cervical spine and muscles associated with the cervical spine. The machine includes a head frame which receives a person's head and a main frame which can receive a person in a seated position. A ball joint is provided for allowing relative movement of the head frame with respect to the main frame, with the ball joint positionable such that it can be located adjacent a desired location along the person's cervical thoracic junction.

The Miller Patent discloses an isotonic cervical exercise device for exercising the muscles surrounding the cervical spine of a person. It comprises a belt adapted to be secured about the waist of a person and includes frontal and posterior portions. It further comprises a chin cup adapted to fit around a person's chin, and a head band which is adapted to fit around the person's head and includes frontal and posterior portions. A first elastic strap is adapted to apply tensile loads between a right frontal portion of the chin cup, diagonally across the person's head, and the posterior portion of the belt. A second elastic strap is adapted to apply tensile loads between a left frontal portion of the chin cup, diagonally across the person's head, and the posterior portion of the belt. A third elastic strap is adapted to apply tensile loads between the front of the chin cup and the front of the belt. A fourth elastic strap is adapted to apply tensile loads between the frontal portion of the head band, backwards across the person's head, and the posterior portion of the belt.

The McCormick Patent discloses an apparatus for monitoring the motion of the lumbar spine. It comprises a rotatable platform upon which the patient is adapted to stand, and the platform pivotable about a vertical axis, so that the platform may be pivoted to a selected angle and held in the selected position. There is provided a lever arm which is rotatable about a horizontal axis which is adapted to pass through the lumbro-sacral junction of the patient, and a first upper body engaging member is releasably mounted to the lever arm. A first computer controlled drive motor pivotally rotates the lever arm in opposite directions with a predetermined program. An overhead frame assembly is also mounted for rotation about the horizontal axis, and a second upper body engaging member is mounted to the overhead frame assembly for rotation about a generally vertical axis which is perpendicular to the horizontal axis.

The Parviainen Patent discloses a spine rehabilitation apparatus. It comprises a frame having a vertical part, an inclined part, and a counter-force device on the vertical part. The frame has an operating linkage with a pivot axle, and a support adapted to rest against the upper body region of the user. The operating linkage is rotatable about the pivot axle; a seat part is on the inclined part of the frame; and below the pivot axle and the support and is adjustably positioned on the inclined part of the frame.

The Scott Patent discloses a spine therapy and exercise device. It comprises a belt member and a harness. The harness is carried by the belt member and is provided for receiving the arms of the wearer.

The Jones Patent discloses a method and apparatus for exercising or testing the strength of muscles in the lower trunk of the body. The patient is seated with his pelvis and legs fixed against movement and with his head, arms and upper back fixed relative to a movement arm which extends above the seat and is mounted for pivotal movement relative to the seat about a horizontal axis. While the movement arm is in a predetermined position, the patient applies a force through the upper back to the movement arm to stress the muscles of the lower trunk, and the strength of these muscles is measured. To exercise these muscles, the movement arm is moved by a force exerted by the upper back against a bias of a resistance weight to lift the weight, and then the force is released to lower the weight and the process is repeated.

None of the above patents have utilized an axial compression of the spine through head loading. It is desirable to provide a very efficient and also very effective design and construction of an axial or vertical loading apparatus for strengthening the bony structures of the spine and the supporting structures of the spine such as discs, ligaments and muscles without causing any range of motion at all. It is also desirable to provide an axial loading apparatus whereby the apparatus is safely secured to the user's head and easily removed when the exercise is completed. It is further desirable to provide an axial loading apparatus which can apply a compressive force on the user's head which will in turn translate directly to the user's vertebral bodies that is realigned with the top of the user's head, wherein the compressive force serves to strengthen the body, ligamentous and muscular structures of the spine.

SUMMARY OF THE INVENTION

The present invention is an axial or vertical loading apparatus for applying a continuous compressive force on top of a patient's head to align the patient's spine with the top of the patient's head. This compressive force is to serve to strengthen the spine, and eliminate weakness in bony structures, discs, ligamentous and muscular tissue around the spine. The compressive force can be applied through various means. The patient can direct how much force will be applied and for how long the force will be applied. As the patient's strength and resistance increase, the weights can be increased and the length of time can be increased.

It is therefore an object of the present invention to provide an axial loading apparatus for applying a compressive force on top of a patient's head to strengthen the spine which is realigned with the top of the patient's head.

It is also an object of the present invention to provide an axial loading apparatus with a means whereby the apparatus is adjustable to fit various people and whereby various resistance levels can be applied.

It is an additional object of the present invention to provide an axial loading apparatus whereby the apparatus is easily and safely secured to and removable from the person's head.

It is a further object of the present invention to provide an axial compression apparatus through placing weights or any compressive means where the bone density of the vertebral body is increased.

Described briefly, the present invention axial loading apparatus primarily stimulates trabecular bone formation inside the cancellous bone of the vertebrae of the cervical spine, thoracic spine and lumbar spine, thoracic spine and lumbar. It, therefore, strengthens the spinal bones as a whole. Under the stress applied to the entire spine through the axial head loading, the paravertebral muscles contract isometrically in order to maintain the posture of the spine. Without such muscle contraction, the vertical posture of the spine will be lost. Such isometric exercise will strengthen the paravertebral muscles as well. Based on the known physiological laws, as the bones and muscles strengthen, the discs and ligaments become stronger accordingly.

The axial loading apparatus is expected to reduce the chances for the development of osteoporosis of the spine after middle age. As is well-known, osteoporosis is a common spine problem in the middle aged woman and men as well as the elderly and causes them to suffer recurring multiple vertebral body compression fractures with long periods of disability. The apparatus may be used as a significant mechanical addition to the treatment of the ongoing osteoporosis in this age group as well.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 2:
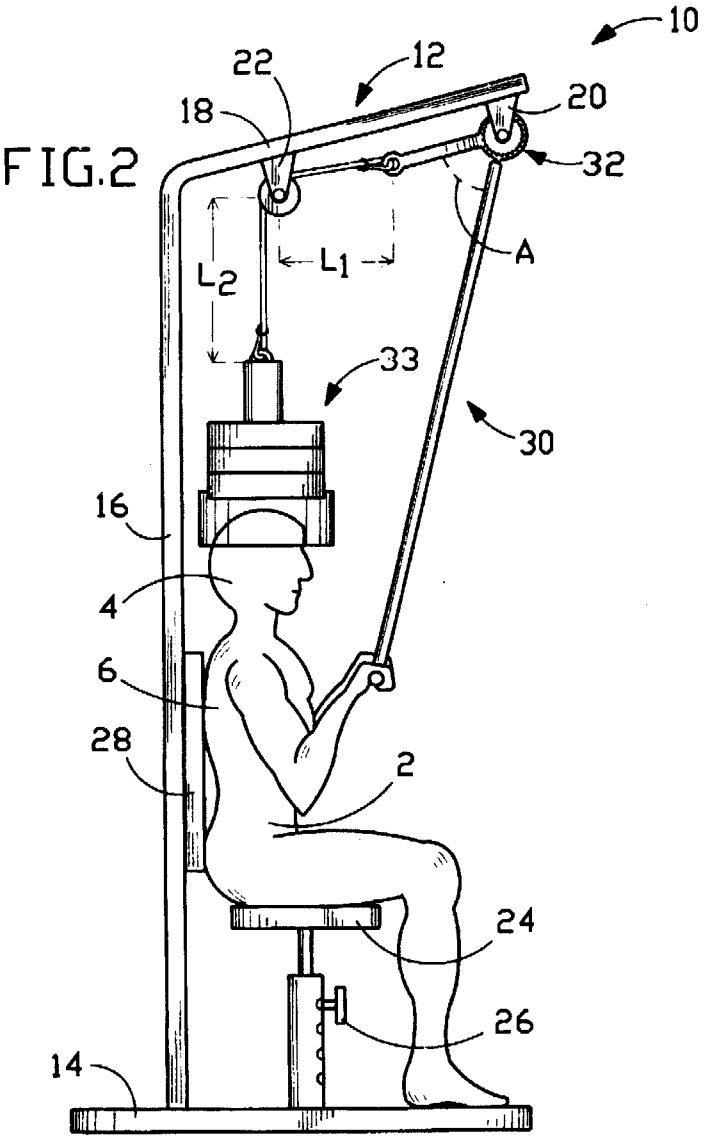
FIG. 2 illustrates the present invention axial loading apparatus in its loaded position, showing the weights loaded on the patient's head.
Figure 1:
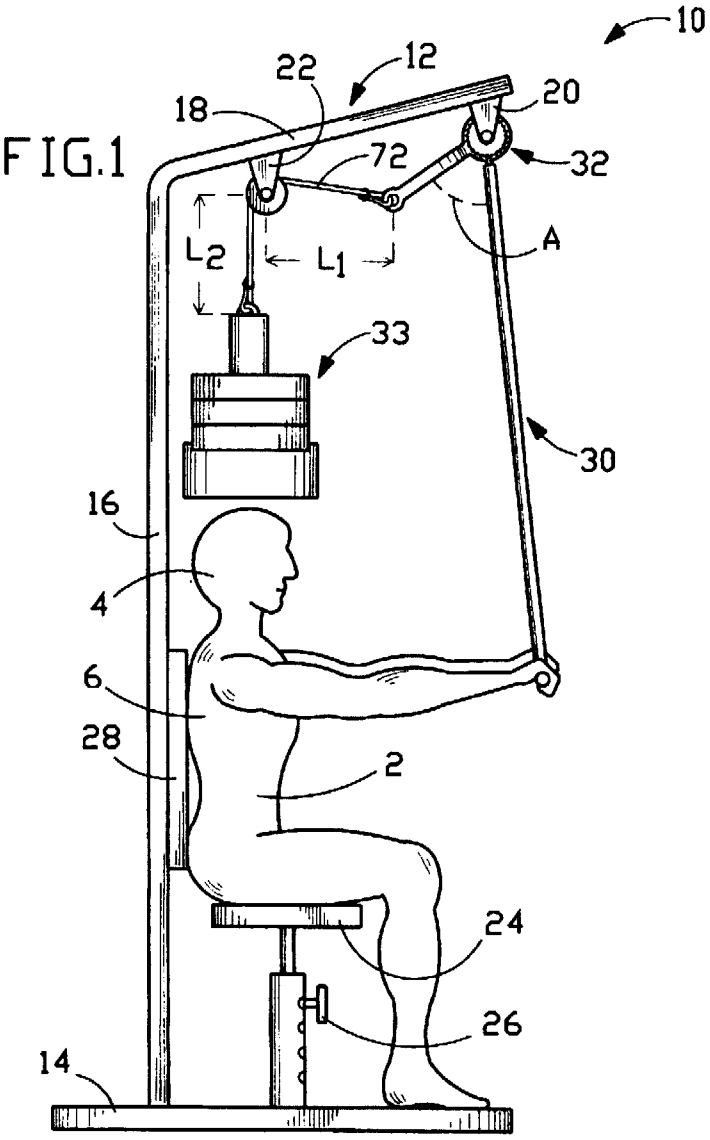
FIG. 1 illustrates the present invention axial loading apparatus in its initial position, showing the weights not loaded on the head of a patient.

FIG. 1 illustrates the present invention axial loading apparatus 10 in its initial position, which is not loaded on a head 4 of a patient or user 2. FIG. 2 illustrates the present invention axial loading apparatus 10 in its loaded position, which is loaded on the patient's head 4 for strengthening the patient's spine. Referring to FIGS. 1 and 2, the axial loading apparatus 10 comprises a frame member 12 which has a generally flat base portion 14, a generally vertical portion 16 affixed to and extending upwardly from the base portion 14, and a top inclined portion 18 integrally connected to the top end of the vertical portion 16 and extending outwardly away from the vertical portion 16. An adjustable seat 24 is provided with the frame member 12, and the height of the seat 24 is adjustable with an adjustment means 26 so that any particular user may utilize the present invention axial loading apparatus 10. A back support 28 is used in conjunction with the seat 24 and is slidably installed on the vertical portion 16 of the frame member 12 by conventional means and located adjacent to the seat 24 for supporting the user's back 6.

Figure 3:
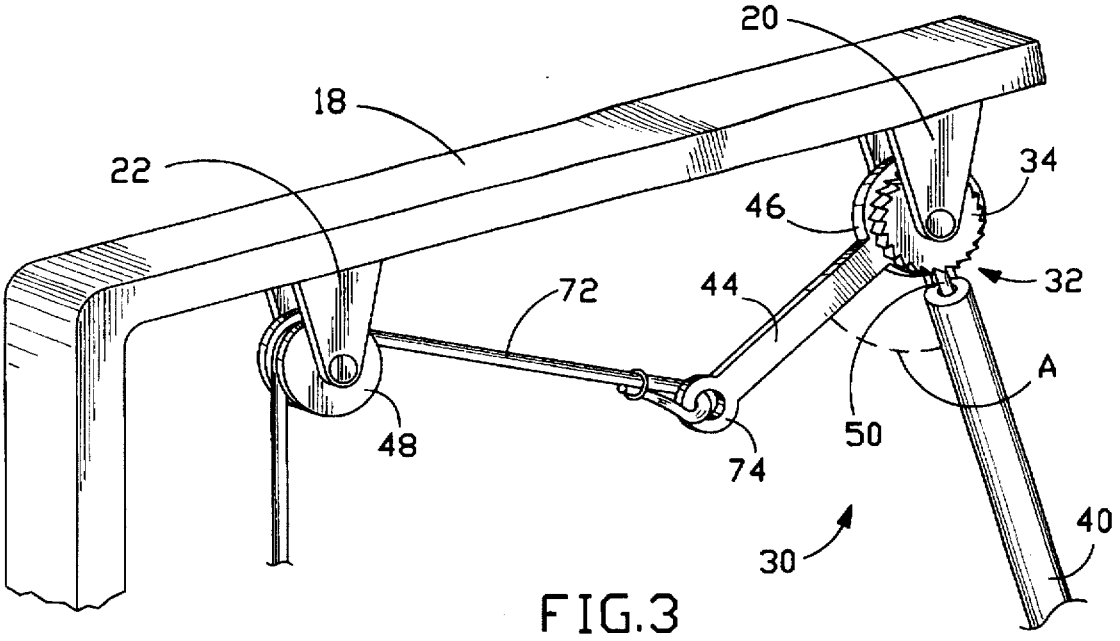
FIG. 3 is an enlarged perspective view of the actuator and locking mechanisms of the present invention axial loading apparatus, showing that the locking mechanism is engaged and the apparatus is in its initial position (not loaded)
Figure 4:
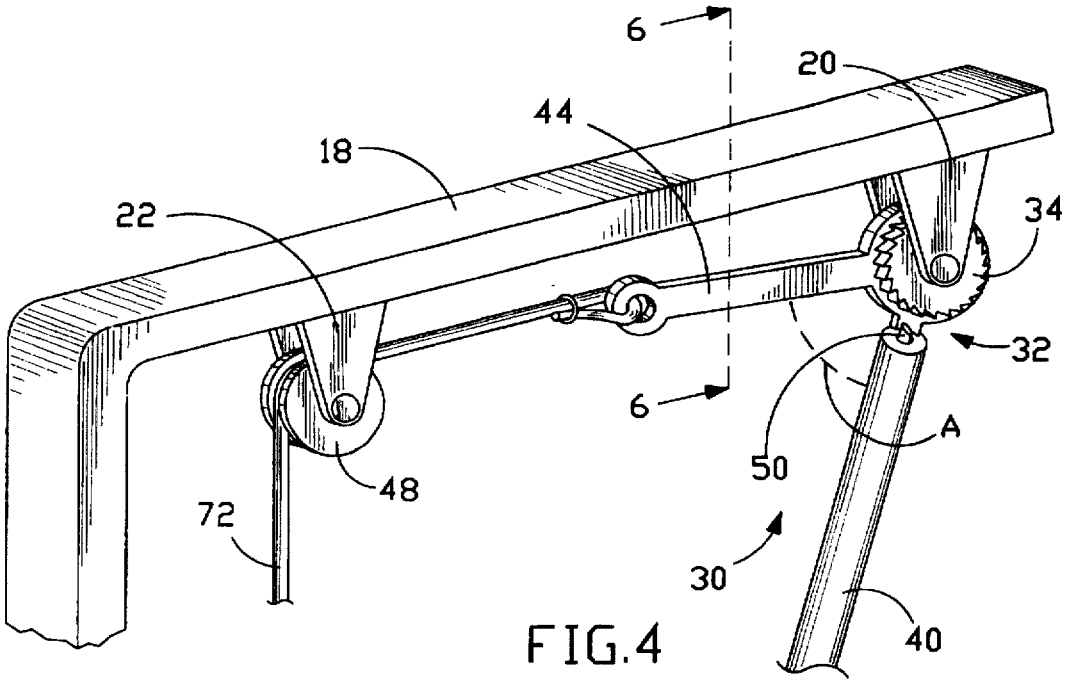
FIG. 4 is an enlarged perspective view of the actuator and locking mechanisms of the present invention axial loading apparatus, showing that the locking mechanism is disengaged and the apparatus is in its loaded position.
Figure 7:
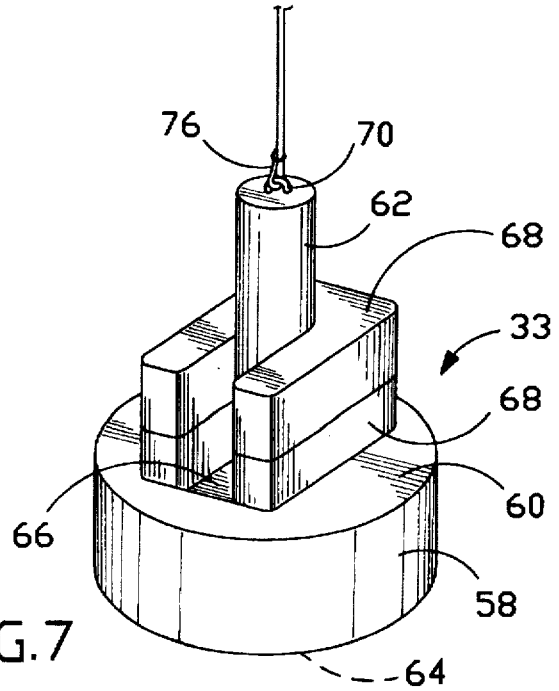
FIG. 7 is an enlarged perspective view of the loading and holding mechanism of the present invention axial loading apparatus.

Referring to FIGS. 3 and 4, the present invention axial loading apparatus 10 further comprises an actuator mechanism 30, a locking mechanism 32, and a loading and holding mechanism 33 (see FIGS. 1 and 7). A pair of spaced apart yoke members 20 and 22 are provided and affixed to the lower side of the top inclined portion 18 of the frame member 12 by conventional means. Each yoke member has two opposite sides with a horizontal pivot axle therebetween.

Referring to FIGS. 3, 4, 5 and 6, the actuator mechanism 30 comprises an upper circular shaped bracket portion 38 and an elongated hollow handle portion 40 integrally connected to a bottom part 42 of the bracket portion 38. The circular shaped bracket portion 38 is rotatably installed on the horizontal pivot axle provided on the first yoke member 20 and pivots about the pivot axle. A linkage arm 44 is integrally connected to a side part 46 of the circular shaped bracket portion 38 of the actuator mechanism 30 and extends outwardly therefrom. The linkage arm 44 moves according to the movement of the handle portion 40, and therefore the angle "A" between the linkage arm 44 and the handle portion 40 is fixed and remains unchanged during the usage of the apparatus. A typical free spinning pulley 48 is rotatably installed on the second yoke member 22 and is used in conjunction with the actuator mechanism 30.

Again referring to FIGS. 5 and 6, the locking mechanism 32 comprises a ratchet wheel 34 which is permanently fixed to one side of the first yoke member 20 and located relative to the circular shaped bracket portion 38 of the actuator mechanism 30. The ratchet wheel 34 has a central aperture in which the pivot axle extends therethrough. A reciprocating pin 50 is slidably installed in an upper compartment 54 of the hollow handle portion 40 of the actuator mechanism 30 and is biased outwardly by a coil spring 52 to engage it onto the notches of the ratchet wheel 34 for locking the handle portion 40 thereto and preventing undesirable movement of the hollow handle portion 40 of the actuator mechanism 30. A conventional switch means 56 is also provided with the locking mechanism 32 and is installed on lowermost part of the handle portion 40 for disengaging the reciprocating pin 50 from the notches of the ratchet wheel 34, which in turn allows the handle portion 40 to move towards the user 2 to apply an axial load onto the person's head 4.

Figure 5:
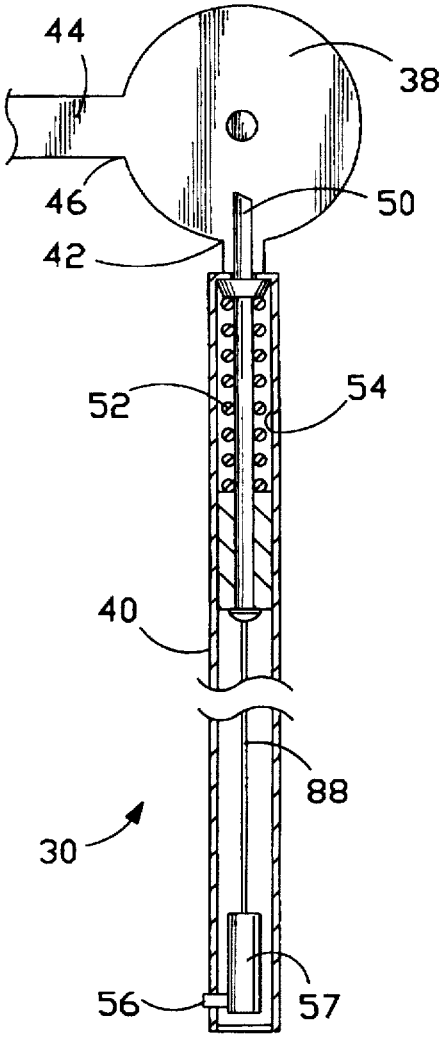
FIG. 5 is a partial cross-sectional view of the locking mechanism of the present invention axial loading apparatus.
Figure 6:
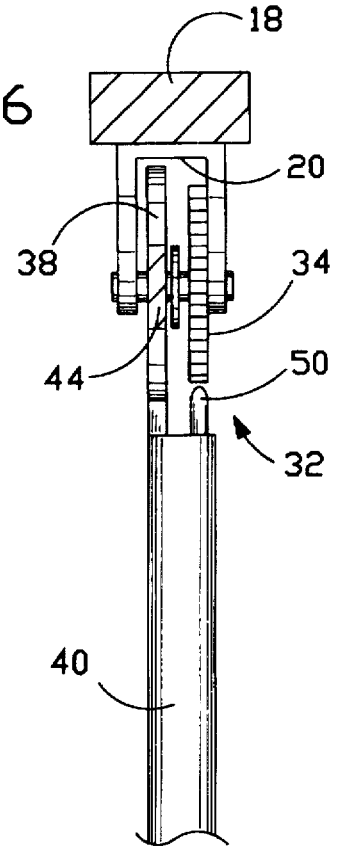
FIG. 6 is a partial cross-sectional view taken along line 6—6 of FIG. 4.

Referring to FIG. 5, an elongated first cable means 88 has one end connected to a bottom end of the reciprocating pin 50 and the other end is connected to the switch means 56. As the switch means 56 is activated or depressed, the cable means 88 is compressed by the conventional compressing means 57, and thereby pulls the reciprocating pin 50 downward into the handle portion 40 to disengage from the ratchet wheel 34 so that the handle portion 40 is movable.

Referring to FIG. 7, the loading and holding mechanism 33 comprises a helmet support 58 which has a top external surface 60, a vertical support post 62 affixed to the top external surface 60, and a lower internal surface 64 which conforms to the person's head. The top external surface 60 has a generally configured cavity 66 which generally conforms to the shape of a deadweight 68. The vertical support post 62 has a latch means 70 located on its free end. The deadweight 68 is generally U-shape to fit the vertical support post 62 so that a plurality of dead weights can be fitted thereto. The dead weights 68 are preferably five pound weights.

Referring to FIGS. 1, 2, 3, 4, and 7, there is shown an elongated second cable means 72 which is provided with the present invention axial loading apparatus 10. The second cable means 72 looped on the free spinning pulley 48 as shown, with one end 74 coupled to the linkage arm 44 and the other end 76 coupled to the latch means 70 of the vertical support post 62 of the loading and holding mechanism 33.

The patient seats himself or herself on the seat 4, and the height of the seat 4 is adjusted with the adjustment means 26 so that the patients's head 4 is positioned below the loading and holding mechanism 33. To activate the axial loading apparatus 10, the patient 2 grasps and pulls the hollow handle portion 40 toward himself or herself while depressing the switch means 56 so that the reciprocating pin 50 is disengaged with the ratchet wheel 34. The circular shaped bracket portion 38 rotates which in turn moves the linkage arm 44 to a position that is substantially parallel to the top inclined portion 18 of the frame member 12. In this position, the cable length "$L_1$" becomes shorter while the cable length "$L_2$" becomes longer so that the loading and holding mechanism 33 is axially loaded on the patient's head 4 (see FIG. 2). In the initial position of the second cable means 72, the cable length at "$L_1$" is longer while the cable length at "$L_2$" is shorter, and thereby no axial loading is accomplished (see FIG. 1). The patient can position as many weights 68 on the loading and holding mechanism 33 as he or she head can handle, where the axial loading apparatus 10 applies the axial load on the patient's head which in turn strengthens the patient's spine. The patient is able to direct how much force will be applied and for how long the force will be applied. Initially, it will clearly be only for a few minutes and thereafter as the patient's strength and resistance increase, the weights 68 can be increased and the length of time can be increased. The concept is to have a compressive force placed on the patient's head which will in turn translate directly to this patient's spine which is realigned with the top of the patient's head. The loading and holding mechanism 33 applies a compressive load on top of the patient's head and serves to compress the spine and thereby strengthen the spine.

The present invention axial loading apparatus strengthens the spinal structures such as bones, discs, and ligaments, which in turn makes the entire spine stronger, where the bone density inside the vertebral body is strengthened and increased.

The present invention conforms to conventional forms of manufacture or any other conventional way known to one skilled in the art.

It will be appreciated that the present invention is not limited to be adjusted either by a technician or by the patient himself or herself. It is emphasized that the loading of the weights can be accomplished by several different methods by which the weights are applied to the loading and holding mechanism. The compressive force can be applied through various means. For example, hydraulic means, electrical means, or a force means such as a fluid filling a cylinder which then rests on top of the patient's head.

The present invention axial loading apparatus may further comprise an electronic measuring gage to measure the force level applied on the top of the patient's head.

Defined in detail, the present invention is an axial loading apparatus for strengthening the bone structure of a spine of a person, the apparatus comprising: (a) a frame member having a base portion, a vertical portion affixed to the base portion and extending upwardly from the base portion, and a top inclined portion integrally connected to a top end of the vertical portion and extending outwardly away from the vertical portion; (b) a first yoke member affixed to the top inclined portion of the frame member and extending downwardly therefrom; (c) a second yoke member affixed to the top inclined portion of the frame member and spaced apart from the first yoke member and extending downwardly therefrom; (d) an actuator mechanism including an upper bracket portion and a lower elongated hollow handle portion integrally connected to a bottom part of the bracket portion and extending downwardly therefrom, the bracket portion rotatably installed on the first yoke member; (e) a locking mechanism including a ratchet wheel permanently fixed to one side of the first yoke member and adjacent to the bracket portion of the actuator mechanism and a reciprocating pin slidably installed within an upper part of the hollow handle portion of the actuator mechanism and biased by a coil spring to engage the pin onto the ratchet wheel to prevent the hollow handle portion from moving in a direction of loading; (f) a linkage arm connected to a side part of the bracket portion of the actuator mechanism and extending outwardly therefrom; (g) a free spinning pulley rotatably installed on the second yoke member; (h) a loading and holding mechanism including a helmet support with a top external holding cavity, a lower internal surface conforming to the person's head, and a vertical support extending upwardly from the external holding cavity; (i) an elongated cable movably installed on the free spinning pulley and having one end attached to the linkage arm and the other end attached to the vertical support of the loading and holding mechanism; (j) an adjustable seat extending upwardly from the base portion of the frame member for receiving the person; (k) a back support adjustably connected to the vertical portion of the frame member for supporting a person's back; (l) a plurality of U-shaped weights being adapted to be vertically stacked on top of each other and positioned on the external holding cavity of the loading and holding mechanism; and (m) means for disengaging the reciprocating pin from the ratchet wheel which in turn allows the hollow handle portion of the actuator mechanism to move towards the person's body to apply the loading onto the person's head by the loading and holding mechanism to strengthen the person's spine; (n) whereby the axial loading apparatus applies the loading on the person's head which in turn applies a compressive force to strengthen the person's spine.

Defined broadly, the present invention is a vertical loading apparatus for strengthening a spine of a person, the apparatus comprising: (a) a frame member having a base portion, a vertical portion affixed to the base portion and extending upwardly from the base portion, and a top portion connected to one end of the vertical portion and extending outwardly away from the vertical portion; (b) a pair of spaced apart yoke members affixed to the top portion of the frame member and extending downwardly therefrom; (c) a bracket rotatably installed on one of the pair of yoke members; (d) an elongated hollow handle connected to the bracket and extending downwardly therefrom; (e) a ratchet wheel permanently fixed to one side of the one of the pair of yoke members and adjacent to the bracket; (f) a reciprocating pin slidably installed within the hollow handle and biased by a spring means to engage the pin onto the ratchet wheel to prevent the hollow handle from moving in a direction of loading; (g) a linkage arm connected to the bracket and extending outwardly therefrom; (h) a free spinning pulley rotatably installed on the other one of the pair of yoke members; (i) a helmet support having an external cavity, an internal surface conforming to the person's head, and a vertical support extending upwardly from the external holding cavity; (j) an elongated cable movably installed on the free spinning pulley and having one end attached to the linkage arm and the other end attached to the vertical support of the helmet support; (k) a plurality of weights being adapted to be vertically stacked on top of each other and positioned on the external cavity of the helmet support; and (l) means for disengaging the reciprocating pin from the ratchet wheel which in turn allows the hollow handle to move towards the person's body to apply the loading onto the person's head for strengthening the person's spine; (m) whereby the vertical loading apparatus applies the loading on the person's head which in turn applies a compressive force to strengthen the person's spine.

Defined more broadly, the present invention is a loading apparatus to be used by a person, comprising: (a) a frame member; (b) an actuator means; (c) means for locking the actuator means to prevent the actuator means from being actuated in a direction of loading; and (d) a loading means for holding at least one weight to provide a load onto a person's head, where the locking means unlocks the actuator means so that the actuator means actuates the load of the loading means onto the person's head; (e) whereby the loading apparatus applies the load onto the person's head which in turn applies a compressive force to strengthen the person's spine.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An axial loading apparatus for strengthening bony structure of a spine of a person, the apparatus comprising:

a. a frame member having a base portion, a vertical portion affixed to the base portion and extending upwardly from the base portion, and a top inclined portion integrally connected to a top end of the vertical portion and extending outwardly away from the vertical portion;

b. a first yoke member affixed to said top inclined portion of said frame member and extending downwardly therefrom;

c. a second yoke member affixed to said top inclined portion of said frame member and spaced apart from said first yoke member and extending downwardly therefrom;

d. an actuator mechanism including an upper bracket portion and a lower elongated hollow handle portion integrally connected to a bottom part of the bracket portion and extending downwardly therefrom, the bracket portion rotatably installed on said first yoke member;

e. a locking mechanism including a ratchet wheel permanently fixed to one side of said first yoke member and adjacent to said bracket portion of said actuator mechanism and a reciprocating pin slidably installed within an upper part of said hollow handle portion of said actuator mechanism and biased by a coil spring to engage the pin onto the ratchet wheel to prevent said hollow handle portion from moving in a direction of loading;

f. a linkage arm connected to a side part of said bracket portion of said actuator mechanism and extending outwardly therefrom;

g. a free spinning pulley rotatably installed on said second yoke member;

h. a loading and holding mechanism including a helmet support with a top external holding cavity, a lower internal surface conforming to a person's head, and a vertical support extending upwardly from the external holding cavity;

i. an elongated cable movably installed on said free spinning pulley and having one end attached to said linkage arm and the other end attached to said vertical support of said loading and holding mechanism;

j. a seat extending upwardly from said base portion of said frame member for receiving a person;

k. a back support connected to said vertical portion of said frame member for supporting a person's back;

l. a plurality of U-shaped weights being adapted to be vertically stacked on top of each other and positioned on said external holding cavity of said loading and holding mechanism; and m. means for disengaging said reciprocating pin from said ratchet wheel which in turn allows said hollow handle portion of said actuator mechanism to move in the direction of loading to apply said helmet support onto a person's head to strengthen a person's spine;

n. whereby said axial loading apparatus may apply a compressive force to strengthen a person's spine.

2. The axial loading apparatus in accordance with claim 1 wherein said disengaging means includes an elongated second cable connected to said reciprocating pin, a compressing means connected to a free end of the second cable, and a switch connected to the compressing means for disengaging said reciprocating pin of said locking mechanism from said ratchet wheel.

3. The axial loading apparatus in accordance with claim 1 wherein each of said plurality of U-shaped weights is five pounds.

4. A vertical loading apparatus for strengthening a spine of a person, the apparatus comprising:

a. a frame member having a base portion, a vertical portion affixed to the base portion and extending upwardly from the base portion, and a top portion connected to one end of the vertical portion and extending outwardly away from the vertical portion;

b. a pair of spaced apart yoke members affixed to said top portion of said frame member and extending downwardly therefrom;

c. a bracket rotatably installed on one of said pair of yoke members;

d. an elongated hollow handle connected to said bracket and extending downwardly therefrom;

e. a ratchet wheel permanently fixed to one side of said one of said pair of yoke members and adjacent to said bracket;

f. a reciprocating pin slidably installed within said hollow handle and biased by a spring to engage the pin onto said ratchet wheel to prevent said hollow handle from moving in a direction of loading;

g. a linkage arm connected to said bracket and extending outwardly therefrom;

h. a free spinning pulley rotatably installed on the other one of said pair of yoke members;

i. a helmet support having an external holding cavity, an internal surface conforming to said person's head, and a vertical support extending upwardly from the external holding cavity;

j. an elongated cable movably installed on said free spinning pulley and having one end attached to said linkage arm and the other end attached to said vertical support of said helmet support;

k. a plurality of weights being adapted to be vertically stacked on top of each other and positioned on said external cavity of said helmet support; and l. means for disengaging said reciprocating pin from said ratchet wheel which in turn allows said hollow handle to move in the direction of holding to apply said helmet support onto a person's head for strengthening a person's spine;

m. whereby said vertical loading apparatus may apply a compressive force to strengthen a person's spine.

5. The vertical loading apparatus in accordance with claim 4 wherein said disengaging means includes an elongated second cable connected to said reciprocating pin, a compressing means connected to a free end of the second cable, and a switch connected to the compressing means for disengaging said reciprocating pin from said ratchet wheel.

6. The vertical loading apparatus in accordance with claim 4 wherein each of said plurality of weights is generally U-shaped.

7. The vertical loading apparatus in accordance with claim 4 wherein each of said plurality of weights is five pounds.

8. The vertical loading apparatus in accordance with claim 4 further comprising vertically adjustable seat extending upwardly from said base portion of a frame member for receiving said person.

9. The axial loading apparatus in accordance with claim 4 further comprising a back support connected to said vertical portion of said frame member for supporting a person's back.

10. A loading apparatus for strengthening a person's spine, the apparatus comprising:

a. a frame member;

b. a loading means for holding at least one weight to provide a load onto a person's head, said loading means comprising a helmet support having a lower internal surface conforming to a person's head and a top external surface having means for holding at least one weight thereon;

c. actuator means connected to said loading means and said frame member for operation by a user to selectively lower said loading means in a loading direction and lift said loading means in an opposite direction; and d. means for selectively locking said actuator means to prevent lowering of said loading means.

e. whereby said loading means may be lowered onto a person's head to apply a compressive force to strengthen a person's spine.

11. The loading apparatus in accordance with claim 10 further comprising a vertically adjustable seat connected to the frame member for receiving a person.

12. The loading apparatus in accordance with claim 10 further comprising a back support connected to the frame member for supporting a person's back.

13. The loading apparatus in accordance with claim 10 wherein said actuator means further comprises a bracket rotatably installed on a first yoke member affixed to said frame member and a hollow handle connected to the bracket.

14. The loading apparatus in accordance with claim 13 wherein said weight holding means comprises a top external cavity in said helmet support and a vertical support extending upwardly from the external cavity, and where said actuator means comprises a cable having one end connected to the frame member and looped on a free spinning pulley which is rotatably installed on a second yoke member affixed to said frame member and another end connected to said bracket.

15. The loading apparatus in accordance with claim 13 wherein said locking means further comprises a ratchet wheel permanently fixed to one side of said first yoke member and adjacent to said bracket and a reciprocating pin slidably installed within said hollow handle and biased by a spring to engage the pin onto the ratchet wheel to prevent said hollow handle from moving in said direction of loading.

16. The loading apparatus in accordance with claim 15 further comprising disengaging means having a second cable connected to said reciprocating pin, a compressing means connected to a free end of the second cable, and a switch connected to the compressing means for disengaging said reciprocating pin from said ratchet wheel which in turn allows said hollow handle to move in the direction of loading to apply said helmet support onto a person's head for strengthening a person's spine.

* * * * *